US006171690B1

(12) United States Patent
Kenny

(10) Patent No.: US 6,171,690 B1
(45) Date of Patent: Jan. 9, 2001

(54) THERMAL TRANSFER MEDIA WITH A MIXTURE OF NON-MELTING SOLID PARTICLES OF DISTINCT SIZES

(75) Inventor: Frank J. Kenny, Centerville, OH (US)

(73) Assignee: NCR Corporation, Dayton, OH (US)

( * ) Notice: Under 35 U.S.C. 154(b), the term of this patent shall be extended for 0 days.

(21) Appl. No.: 09/143,290

(22) Filed: Aug. 28, 1998

(51) Int. Cl.[7] ..... B41M 5/26

(52) U.S. Cl. ..... 428/323; 428/206; 428/207; 428/484; 428/488.1; 428/488.4; 428/913; 428/914

(58) Field of Search ..... 428/484, 488.1, 428/488.4, 323, 206, 207, 913, 914

(56) References Cited

U.S. PATENT DOCUMENTS

| | | |
|---|---|---|
| 3,663,278 | 5/1972 | Blose et al. . |
| 4,315,643 | 2/1982 | Tokunaga et al. . |
| 4,403,224 | 9/1983 | Wirnowski . |
| 4,463,034 | 7/1984 | Tokunaga et al. . |
| 4,523,207 | 6/1985 | Lewis et al. . |
| 4,628,000 | 12/1986 | Talvalkar et al. . |
| 4,687,701 | 8/1987 | Knirsch et al. . |
| 4,698,268 | 10/1987 | Ueyama . |
| 4,707,395 | 11/1987 | Ueyama et al. . |
| 4,777,079 | 10/1988 | Nagamoto et al. . |
| 4,778,729 | 10/1988 | Mitsubishi . |
| 4,869,941 | 9/1989 | Ohki . |
| 4,923,749 | 5/1990 | Talvalkar . |
| 4,975,332 | 12/1990 | Shini et al. . |
| 4,983,446 | 1/1991 | Taniguchi et al. . |
| 4,988,563 | 1/1991 | Wehr . |
| 5,128,308 | 7/1992 | Talvalkar . |
| 5,132,139 | 7/1992 | Mecke et al. . |
| 5,240,781 | 8/1993 | Obata et al. . |
| 5,248,652 | 9/1993 | Talvalkar . |

*Primary Examiner*—Pamela R. Schwartz
(74) *Attorney, Agent, or Firm*—Millen White Zelano & Branigan PC

(57) ABSTRACT

Thermal transfer ribbons that contain mixtures of carbon black and/or other non-melting solids within the thermal transfer layer provide high density images and reduced melt viscosities for the thermal transfer layer where the mixtures contain at least three different sized particles or mixtures of particles and each of the different sized particles comprise 20 to less than 80 volume % of the total volume of the overall particle mixture. Each of the different sized particles also have particle size values which differ from each by a factor of at least 1.5.

13 Claims, 4 Drawing Sheets

THERMAL TRANSFER MEDIA WITH A MIXTURE OF NON-MELTING SOLID PARTICLES OF DISTINCT SIZES

FIELD OF THE INVENTION

This invention pertains to thermal transfer ribbons derived from wax dispersions and emulsions. Such ribbons find use in thermal transfer printing wherein images are formed on a receiving substrate by selectively transferring portions of a thermal transfer layer of a print ribbon to a receiving substrate by heating extremely precise areas thereof with thin film resistors within the print head of a thermal transfer printer. More particularly, the present invention relates to thermal transfer ribbons with thermal transfer layers with a high density of non-melting (hard) particles which transfer rapidly to a receiving substrate and preferably are suitable for use in high speed thermal transfer printers.

BACKGROUND OF THE INVENTION

Thermal transfer printing is widely used in special applications such as in the printing of machine-readable bar codes on labels or directly on articles to be coded. The thermal transfer process employed by these printing methods provides great flexibility in generating images and allows for broad variations in style, size and color of the printed images, typically from a single machine with a single thermal print head. Representative documentation in the area of thermal transfer printing includes the following patents:

U.S. Pat. No. 3,663,278, issued to J. H. Blose et al. on May 16, 1972, discloses a thermal transfer medium having a coating composition of cellulosic polymer, thermoplastic resin, plasticizer and a "sensible" material such as a dye or pigment.

U.S. Pat. No. 4,315,643, issued to Y. Tokunaga et al. on Feb. 16, 1982, discloses a thermal transfer element comprising a foundation, a color developing layer and a hot melt ink layer. The ink layer includes heat conductive material and a solid wax as a binder material.

U.S. Pat. No. 4,403,224, issued to R. C. Winowski on Sep. 6, 1983, discloses a surface recording layer comprising a resin binder, a pigment dispersed in the binder, and a smudge inhibitor incorporated into and dispersed throughout the surface recording layer, or applied to the surface recording layer as a separate coating.

U.S. Pat. No. 4,463,034, issued to Y. Tokunaga et al. on Jul. 31, 1984, discloses a heat-sensitive magnetic transfer element having a hot melt or a solvent coating.

U.S. Pat. No. 4,523,207, issued to M. W. Lewis et al. on Jun. 11, 1985, discloses a multiple copy thermal record sheet which uses crystal violet lactone and a phenolic resin.

U.S. Pat. No. 4,628,000, issued to S. G. Talvalkar et al. on Dec. 9, 1986, discloses a thermal transfer formulation that includes an adhesive-plasticizer or sucrose benzoate transfer agent and a coloring material or pigment.

U.S. Pat. No. 4,687,701, issued to K. Knirsch et al. on Aug. 18, 1987, discloses a heat sensitive inked element using a blend of thermoplastic resins and waxes.

U.S. Pat. No. 4,698,268, issued to S. Ueyama on Oct. 6, 1987, discloses a heat resistant substrate and a heat-sensitive transferring ink layer. An overcoat layer may be formed on the ink layer.

U.S. Pat. No. 4,707,395, issued to S. Ueyama, et al., on Nov. 17, 1987, discloses a substrate, a heat-sensitive releasing layer, a coloring agent layer, and a heat-sensitive cohesive layer.

U.S. Pat. No. 4,777,079, issued to M. Nagamoto et al. on Oct. 11, 1988, discloses an image transfer type thermosensitive recording medium using thermosoftening resins and a coloring agent.

U.S. Pat. No. 4,778,729, issued to A. Mitsubishi on Oct. 18, 1988, discloses a heat transfer sheet comprising a hot melt ink layer on one surface of a film and a filling layer laminated on the ink layer.

U.S. Pat. No. 4,869,941, issued to Ohki on Sep. 26, 1989, discloses an imaged substrate with a protective layer laminated on the imaged surface.

U.S. Pat. No. 4,923,749, issued to Talvalkar on May 8, 1990, discloses a thermal transfer ribbon which comprises two layers, a thermal sensitive layer and a protective layer, both of which are water based.

U.S. Pat. No. 4,975,332, issued to Shini et al. on Dec. 4, 1990, discloses a recording medium for transfer printing comprising a base film, an adhesiveness improving layer, an electrically resistant layer and a heat sensitive transfer ink layer.

U.S. Pat. No. 4,983,446, issued to Taniguchi et al. on Jan. 8, 1991, describes a thermal image transfer recording medium which comprises as a main component, a saturated linear polyester resin.

U.S. Pat. No. 4,988,563, issued to Wehr on Jan. 29, 1991, discloses a thermal transfer ribbon having a thermal sensitive coating and a protective coating. The protective coating is a wax-copolymer mixture which reduces ribbon offset.

U.S. Pat. Nos. 5,128,308 and 5,248,652, issued to Talvalkar, each disclose a thermal transfer ribbon having a reactive dye which generates color when exposed to heat from a thermal transfer printer.

And, U.S. Pat. No. 5,240,781, issued to Obatta et al., discloses an ink ribbon for thermal transfer printers having a thermal transfer layer comprising a wax-like substance as a main component and a thermoplastic adhesive layer having a film forming property.

High speed thermal transfer printers such as "near edge," "true edge," "corner edge" and "Fethr®" printers have been developed, wherein the thin film resistors are positioned right at the edge of the thermal print head, allowing rapid separation of the donor film from the receiving substrate after the thin film resistors are fired.

Conventional general purpose ribbons often cannot meet the requirements of high speed printers since the ribbon and receiving substrate are separated almost instantaneously after the thin film resistors are fired. There is little time for waxes and/or resins to melt/soften and flow onto the surface of the receiving substrate before the ribbon is separated from the receiving substrate. In conventional ribbons, the adhesion of the melted/softened material to the receiving substrate is typically lower than its adhesion to the supporting substrate of the ribbon at the time of separation with a high speed printer. As a result, the functioning thermal transfer layer is usually split and the transfer incomplete, resulting in light printed images where the functional layer is an ink layer.

One approach to this problem has been to increase the speed of transfer of a functional layer to match the capability of high speed printers by using binder components (waxes and resins) having a low melt temperature A problem with this approach is that the environmental stability of such ribbons decreases and the integrity of the print decreases. For example, as the melting point of the wax used to produce the ribbon decreases, the ribbon has a tendency to "block"

wherein the coating transfers to the backside of the ribbon when wound onto itself. This blocking phenomenon tends to occur when the ribbon is subjected to temperatures in the range of 45° to 55° C. and above and when the ribbon is wound onto itself coating side in.

Another approach is to increase the concentration of carbon black to enhance the print density of the image formed. This approach has limitations in that the melt viscosity of the thermal transfer layer increases with the increase in concentration of the non-melting carbon black particles, making transfer more difficult. Reducing the concentration of carbon black within the thermal transfer layer to enhance transfer is counter productive in that light images will still be produced due to the reduction in the print density of the image formed.

It is generally desirable to use carbon black pigments and other non-melting solid components of the thermal transfer media ground to a fine size to simplify dispersion and enhance resolution. One exception is the ribbon of Micke et al., U.S. Pat. No. 5,132,139, which is a thermal printing ribbon with multistrike capacity wherein large size solid particles are employed in a thick thermal transfer layer between 10 and 20 microns (see columns 7, line 21).

SUMMARY OF THE INVENTION

It is an objective of the present invention to provide thermal transfer media such as thermal transfer ribbons which produce high quality images with high print density at high transfer rates and which preferably are suitable for high speed thermal printers where the thermal transfer ribbon is separated from the receiving substrate almost instantaneously after the heating elements of the thermal transfer print head have been fired. It is another object of the present invention to provide thermal transfer media which generate images with improved print density without significantly increasing the viscosity of the thermal transfer layer and preferably reducing the viscosity of the thermal transfer layer. These and other objects of the present invention will become apparent from the detailed description and claims which follow together with the annexed drawings.

The present invention achieves these objects through the discovery that the density of non-melting solid particles within an image can be increased, while maintaining or reducing the melt viscosity of the thermal transfer layer, through the use of a multimodal mixture of non-melting solid pigment particles of at least three different particle sizes. These multimodal mixtures typically have a particle size distribution with three or more sizes. Examples of such particle size distributions are shown in FIGS. 3 and 4, each having three predominant sizes. Such particle size distributions can be obtained by combining individual particulate mixtures, each having a distinct average particle size and particle distribution. Preferably, each of the different particles have particle size values which differ from the size of other particles by a factor of 2.5 or more. The volume percent of each of the different particles within each particle size distribution is preferably at least 15 volume % and less than 80 volume %, based on the total volume of non-melting solid particles in the thermal transfer layer.

The thermal transfer media of this invention comprises a flexible substrate with a thermal transfer layer deposited thereon. This thermal transfer layer comprises a binder and a mixture of non-melting solid particles of at least three different sizes. The particles are preferably a sensible material. The binder typically comprises a wax, and optionally, a thermoplastic resin, both of which are preferably water/solvent-dispersible or emulsifiable. The thermal transfer medium can include other layers wherein the mixture of non-melting solid particles of at least three distinct particle sizes is present in the outer layer.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
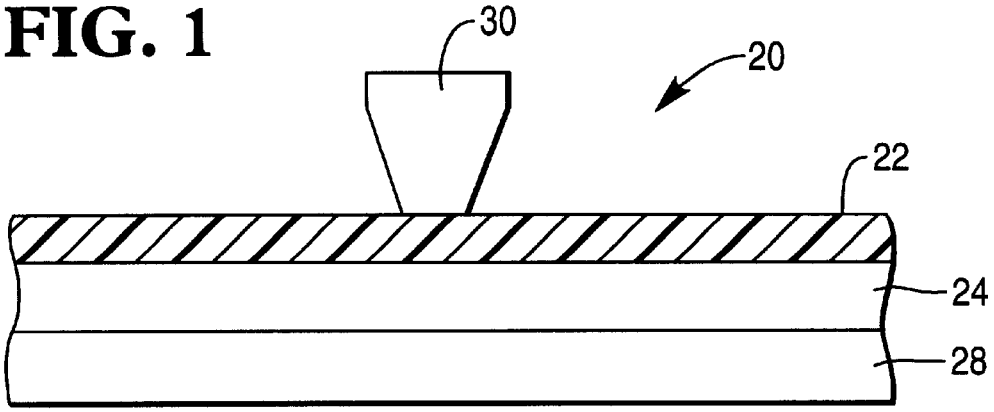
FIG. 1 illustrates a thermal transfer medium of the present invention in a printing operation prior to thermal transfer.
Figure 2:
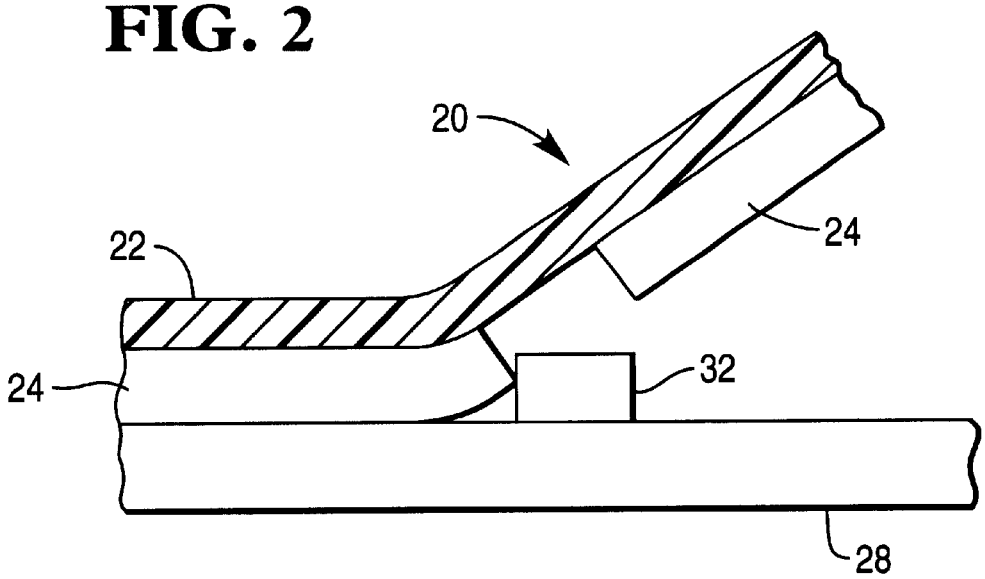
FIG. 2 illustrates a thermal transfer medium of the present invention in a printing operation after thermal transfer.

Thermal transfer ribbon 20, as illustrated in FIGS. 1–2, is a preferred embodiment of this invention and comprises substrate 22 of a flexible material which is preferably a thin smooth paper or plastic-like material. Tissue type paper materials such as 30–40 gauge capacitor tissue, manufactured by Glatz and polyester-type plastic materials such as 14–35 gauge polyester films manufactured by DuPont under the trademark Mylar® are suitable. Polyethylene napthalate films, polyethylene terephthalate films, polyamide films such as nylon, polyolefin films such as polypropylene film, cellulose films such as triacetate film and polycarbonate films are also suitable. The substrates should have high tensile strength to provide ease in handling and coating and preferably provide these properties at minimum thickness and low heat resistance to prolong the life of heating elements within thermal print heads. The thickness is preferably 3 to 50 microns. If desired, the substrate or base film may be provided with a back coating on the surface opposite the thermal transfer layer.

Positioned on substrate 22 is thermal transfer layer 24. The heat from print head 30 melts or softens thermal transfer layer 24 permitting transfer from substrate 22 to receiving substrate 28. Solidification of the transferred layer forms and bonds image 32 onto substrate 28.

Thermal transfer layer 24 has a softening point which enables transfer to a receiving substrate using a conventional thermal transfer printer. Typically, the softening point will fall in the range of 50° C. to 250° C. Preferably the softening point enables the thermal transfer medium to be used in the high speed printers such as "near edge," "true edge," and "Fethr®" thermal transfer printers wherein the thermal ribbon is separated from the receiving substrate almost instantaneously with the firing of heating elements within the thermal print head. To accomplish this, the softening point of the thermal transfer layer is below 150° C. and preferably from 50° C. to 150° C.

The thermal transfer layer of the present invention contains a mixture of non-melting solid particulate material which is preferably a sensible material that is capable of being sensed visually, by optical means, by magnetic means, by electroconductive means or by photoelectric means. There are limits on the amount of non-melting solid particles used in the thermal transfer layer in that increasing concentration leads to an increase in melt viscosity of the thermal transfer layer, restricting transfer by high speed thermal transfer printers. The sensible materials are typically used in an amount of from about 5 to 50% by weight, based on the total weight of said thermal transfer layer, and they are typically pigment particles or magnetic particles used in conventional ink ribbons. Examples of suitable pigment particles include carbon black, cadmium, primrose, chrome yellow, ultra marine blue, and cobalt oxide. Conventional magnetic particles which are incorporated in printed characters or images to enable optical, human or machine reading of the characters or images can also be used in the thermal transfer media of this invention. The magnetic particles in the thermal transfer media provide the advantages of thermal printing while encoding or imaging the substrate with a magnetic signal inducible ink. Examples of suitable magnetic particles include iron oxides and nickel oxides.

Preferred sensible materials are those which can be solubilized, dispersed or emulsified in water or solvent. The most common of such sensible materials is carbon black. Suitable water/solvent dispersible or emulsifiable carbon blacks are those available from Environmental Inks and BASF.

Figure 6:
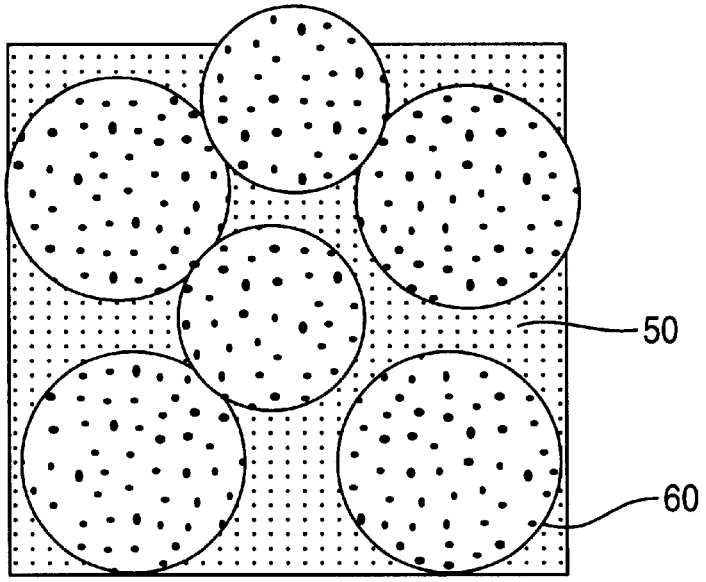
FIG. 6 is a schematic representation of a coating containing non-melting solid particles from a single mixture of particles.
Figure 7:
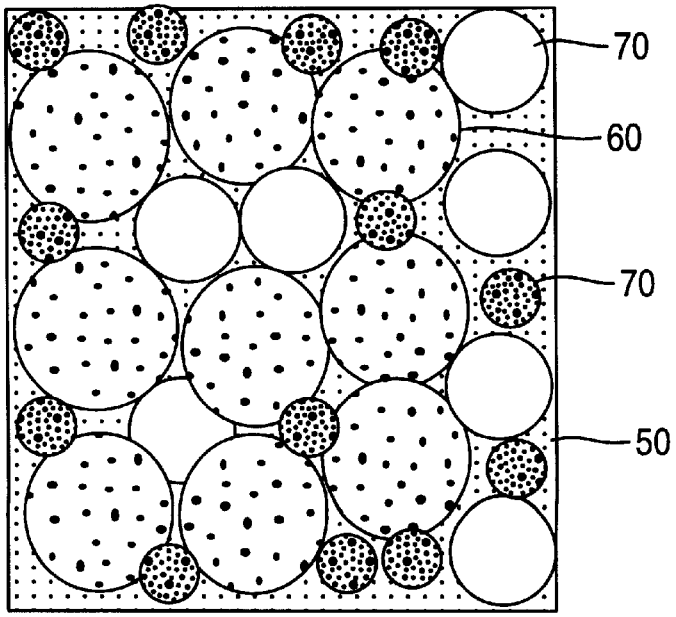
FIG. 7 is a schematic representation of a coating containing non-melting solid particles of three different mixtures of particles of different sizes.

The mixture of non-meltable solid particles contains particles of three different sizes to so as to force the binder out of the interstices between the larger particles. This is shown in FIGS. 6 and 7. In FIG. 6, binder 50 penetrates the interstices between the particles. By introducing a mixture of particles of distinct particle sizes, the smaller particles 70 force out the binder 50 from the interstices and the volume fraction of the particles is effectively decreased, as shown in FIG. 7, the melt viscosity of the thermal transfer layer is reduced.

To effectively fill the interstices, the size of the different particles within the mixture differ by a factor of at least 1.5, preferably at least 2.5. In addition, to effectively fill the interstices, it is also preferable to use at least three different size particles or mixtures of particles. More than 6 different sizes or mixtures can result in an overall particle size distribution that is analogous to a unimodal particle distribution shown in FIG. 5, particularly if the difference in particle sizes is small and/or the size distribution for each mixture is wide.

The particles of different sizes used within the mixture are typically individual mixtures with a narrow particle size distribution and the "sizes" are actually average values. The particle size distributions for these individual mixtures must be sufficiently narrow such that they provide a multimodal particle distribution for the overall mixture. This is accomplished if the standard deviation in particle size for the individual mixture is less than 25% of the average particle size for the individual mixture. A predominant particle size is one which provides a mode in a multimodal particle size distribution.

Figure 3:
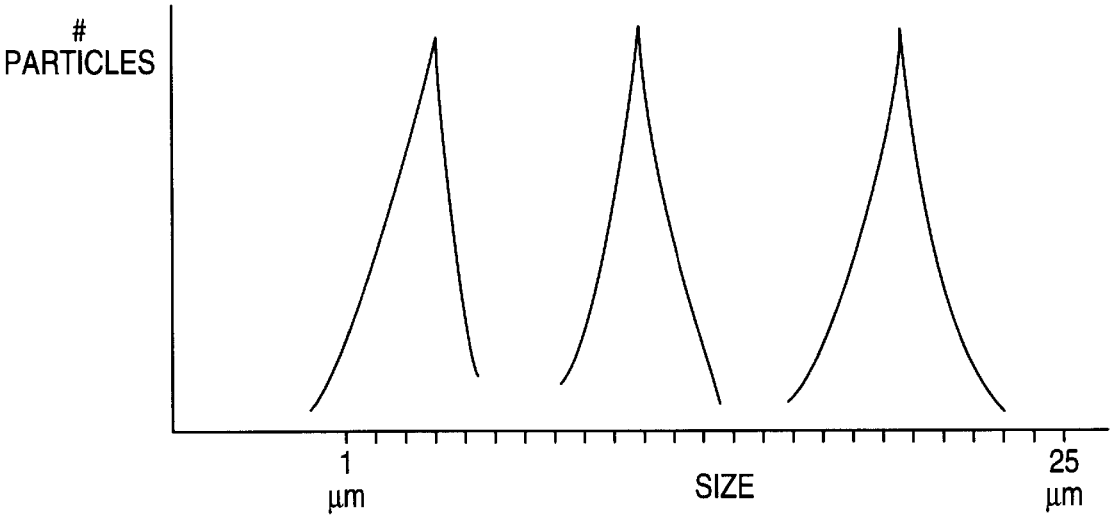
FIG. 3 is a graph illustrating an example of a particle size distribution for a mixture of non-melting solid particles used within a thermal transfer medium of the present invention.
Figure 4:
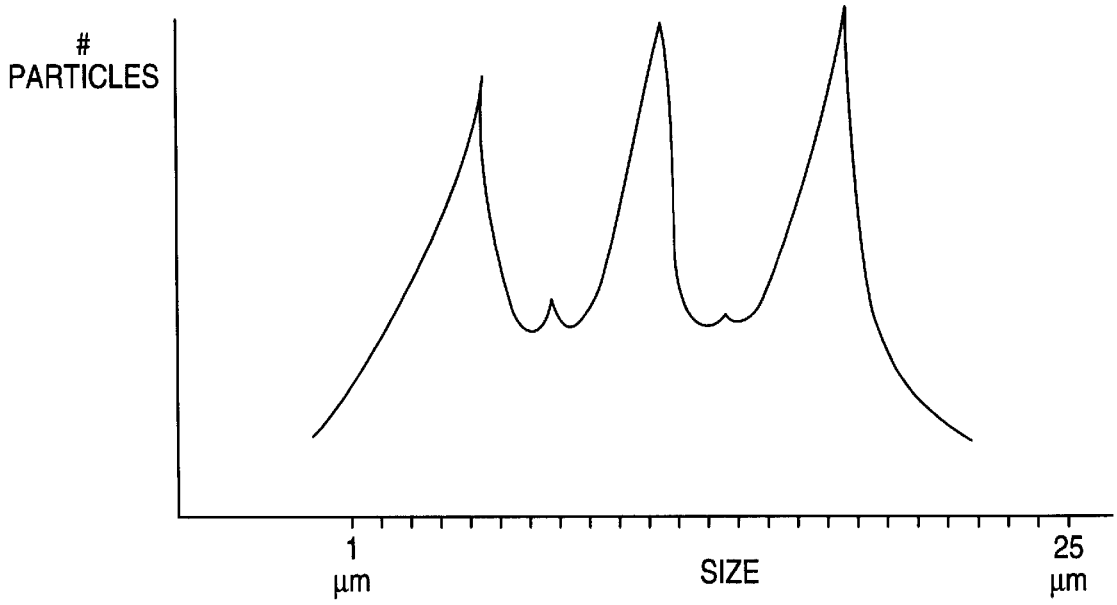
FIG. 4 is a graph illustrating another example of a particle size distribution for a mixture of non-melting solid particles used within a thermal transfer medium of the present invention.

FIG. 3 shows a particle size distribution for an overall mixture wherein the individual mixtures used to form the overall mixture have narrow particle size distributions such that sizes within each distribution do not overlap. FIG. 4 shows a particle size distribution for an overall mixture wherein the individual mixtures used to form the overall mixture have wide particle size distributions such that sizes within each distribution overlap.

Particles of different sizes must be used in a sufficient quantity to ensure filling of the interstices. This can be accomplished by using amounts of each of the different sized particles in the range of 15 to 80 volume % where 3–6 different sized particles are used. Lower amounts may be used if 2 or more different sized particles filled the same interstices.

Although particle size distributions consistent with FIGS. 3 and 4 can be prepared by combing individual mixtures, it is contemplated that a particle size distribution consistent with FIGS. 3 and 4 can be obtained for a single batch of particles with special screening and controlled grinding time.

The thermal transfer layer also comprises a conventional binder used in thermal transfer ribbons. Suitable binders include waxes, thermoplastic resins and reactive resins described below. The thermal transfer layer of the thermal transfer medium of this invention preferably has a binder which contains a water/solvent-emulsifiable wax and thermoplastic resin.

Wax is typically a main component of the binder. Suitable waxes include those used in conventional thermal transfer ribbons. Examples include natural waxes such as carnauba wax, candelilla wax, bees wax, rice bran wax, lanolin, motan wax and ceresin wax; petroleum waxes such as paraffin wax and microcrystalline waxes; synthetic hydrocarbon waxes such as low molecular weight polyethylene and Fisher-Tropsch wax; higher fatty acids such as myristic acid, lauric acid, palmitic acid, stearic acid and behenic acid; higher aliphatic alcohols such as stearyl alcohol and esters such as sucrose fatty acid esters and sorbitane fatty acid esters and anides. Mixtures of waxes can also be used. The melting point of the wax falls below 200° C. and is preferably within the range of from 40° C. to 150° C., most preferably from 60° C. to 100° C. When used, the total amount of wax within the thermal transfer layer is above 5 wt. % and preferably ranges from 35–95 wt. %, most preferably 50–80 wt. %, based on the total weight of solids (dry ingredients).

The thermal transfer layer may also contain a thermoplastic resin. Any thermoplastic resin used in conventional thermal transfer ribbons is suitable. The total amount of the thermoplastic resin is less than 50 wt %, based on total solids within the thermal transfer layer. Preferably, less than 20 wt. % thermoplastic resin is used for high speed printer applications and most preferably, the amount used ranges from 3 to 15 wt. % for high speed printer applications, wherein in each case, wt. % is based on total solids within the thermal transfer layer.

The thermoplastic resin has a softening point below 225° C., preferably within the range of 50° C. to 150° C. for high speed printer applications. Examples of suitable thermoplastic resins include those described in U.S. Pat. Nos. 5,240,781 and 5,348,348 and the following resins: polyvinylchloride, polyvinyl acetate, vinyl chloride-vinyl acetate copolymers, polyethylene, polypropylene, polyacetal, ethylene-vinyl acetate copolymers, ethylene alkyl (meth)acrylate copolymers, ethylene-ethyl acetate copolymers, polystyrene, styrene copolymers, polyamide, ethylcellulose, polyketone resin, xylene resin, petroleum resin, terepene resin, polyurethane resin, polyvinyl butyryl, styrene-butadiene rubbers, nitrite rubber, acrylic rubber, polyamides, ethylcellulose, ethylene-propylene rubber, ethylene alkyl (meth)acrylate copolymer, styrene-alkyl (meth)acrylate copolymer, acrylic acid-ethylene-vinyl acetate terpolymer, acrylic acid-ethylene ethylacetate terpolymer, (meth)acrylic acid-alkylene alkylacetate terpolymers, saturated polyesters as described in U.S. Pat. No. 4,983,446, and sucrose benzoate.

Reactive resins used as binders in conventional thermal ribbons are also suitable. Examples include epoxy resins in a combination with polymerization initiators (crosslinkers). Suitable epoxy resins include those that have at least two oxirane groups such as epoxy novolak resins obtained by reacting epichlorohydrin with phenol/formaldehyde condensates or cresol/formaldehyde condensates. Another preferred epoxy resin is polyglycidyl ether polymers obtained by reaction of epichlorohydrin with a polyhydroxy monomer such as 1,4 butanediol. The epoxy resins are preferably employed with a crosslinker which is activated upon exposure to the heat from a thermal print head. Preferred crosslinkers include polyamines with at least two primary or secondary amine groups. Accelerators such as triglycidyl-isocyanurate can be used with the crosslinker to accelerate the reaction. When used as a binder, the epoxy resins typically comprise more than 25 weight percent of the thermal transfer layer. Waxes are typically not necessary when reactive epoxy resins are used in the binder.

As indicated above, water/solvent-emulsifiable waxes and thermoplastic resins are a preferred binder component. Aqueous/solvent emulsions of these waxes and thermoplastic resins are typically obtained by employing high shear agitation such as from a conventional high speed impeller or an attritor with steel grind media. The average particle size for the waxes and thermoplastic resins is typically less than 50 microns. Surfactants and/or emulsifiers are sometimes used to aid in dispersing or emulsifying the thermoplastic resin or wax within the aqueous/solvent medium.

The thermal transfer layer may contain plasticizers, such as those described in U.S. Pat. No. 3,663,278, to aid in processing of the thermal transfer layer. Suitable plasticizers are adipic acid esters, phthalic acid esters, ricinoleic acid esters sebasic acid esters, succinic acid esters, chlorinated diphenyls, citrates, epoxides, glycerols, glycols, hydrocarbons, chlorinated hydrocarbons, phosphates, and the like. The plasticizer provides low temperature sensitivity and flexibility to the thermal transfer layer so as not to flake off the substrate.

The thermal transfer layer may contain other additives including flexibilizers such as oil, weatherability improvers such a UV light absorbers, fillers, emulsifiers, dispersants, surfactants, defoaming agents, flow adjusters, leveling agents and photostabilizers. Examples of flow adjusters are low molecular weight organic polysiloxanes. Examples of leveling agents are low molecular weight polysiloxane/polyether copolymers and modified organic polysiloxanes, which may be used in an amount of 0.01–10 wt. % based on the weight of solids within the thermal transfer layer.

The thermal transfer media of the present invention may have two or more layers wherein the thermal transfer layer having the mixture of particles with distinct particle sizes is the outer layer.

The thermal transfer media of the present invention can be prepared by applying a coating formulation to the substrate to form the thermal transfer layer by conventional coating techniques such as those which employ a Meyer Rod or similar wire-wound doctor bar set up on a typical solvent coating machine to provide a coating thickness, once dried, preferably in the range of 2 to 5 microns. Suitable thermal transfer layers are derived from coating formulations having approximately 20 to 55% by weight dry ingredients (solids). A temperature of approximately 100° F. to 150° F. is typically maintained during the entire coating process. After the coating is applied to the substrate, the substrate is typically passed through a dryer at an elevated temperature to ensure drying and adherence of the coating 24 onto substrate 22 in making the transfer ribbon 20.

The thermal transfer media of the present invention provide all the advantages of thermal transfer printing. When the thermal transfer layer is exposed to the heating elements (thin film resistors) of the thermal transfer print head, the thermal transfer layer is transferred from the ribbon substrate to the receiving substrate 28 in a manner to produce precisely defined characters 32. Preferably the thermal transfer layer can be fully transferred onto a receiving substrate with the use of high speed thermal transfer printers.

Without further elaboration it is believed that one skilled in the art can, using the preceding description, utilize the present invention to its fullest extent. The following preferred specific embodiments are, therefore, to be construed as merely illustrative and are not limiting of the remainder of the disclosure in anyway whatsoever. All applications, patents and publications cited above and below are hereby incorporated by reference.

EXAMPLES

Example 1

A formulation with the components recited below in Table 1 is coated on 18 gage polyester film and dried at about 180° F. to obtain a thermal transfer ribbon of the present invention with a thermal transfer layer having a mixture of particles with a particle size distribution consistent with FIG. 3.

TABLE 1

| Ingredient | Dry Range | Dry Percent | Wet Weight |
|---|---|---|---|
| Wax emulsion [1] | 50 to 80 wt. % | 60% | |
| Carbon black dispersion I [2] | 1 to 20 wt. % | 7% | |
| Carbon black dispersion II [3] | 1 to 20 wt. % | 7% | |
| Carbon black dispersion III [4] | 1 to 20 wt. % | 7% | |
| Polyethylene oxide | 2 to 20 wt. % | 19% | |
| Wetting agent | | | 2.5 |
| D.I. water | | | 119 |
| TOTALS | | 100% | |

[1] Emulsion 22854 - carnauba/paraffin/resin emulsion.
[2] Carbon black dispersion (29%) ground for 60 minutes.
[3] Carbon black dispersion (29%) ground for 120 minutes.
[4] Carbon black dispersion (29%) ground for 180 minutes.

Full transfer of the coating from the ribbon is observed on a step wedge at a temperature in the range of 260° F. to 300° F. The thermal transfer layer provides images at a print density of 2.15 and above has a complex viscosity of less than $8\times10^5$ mPAs at 150° C.

Example 2

Figure 5:
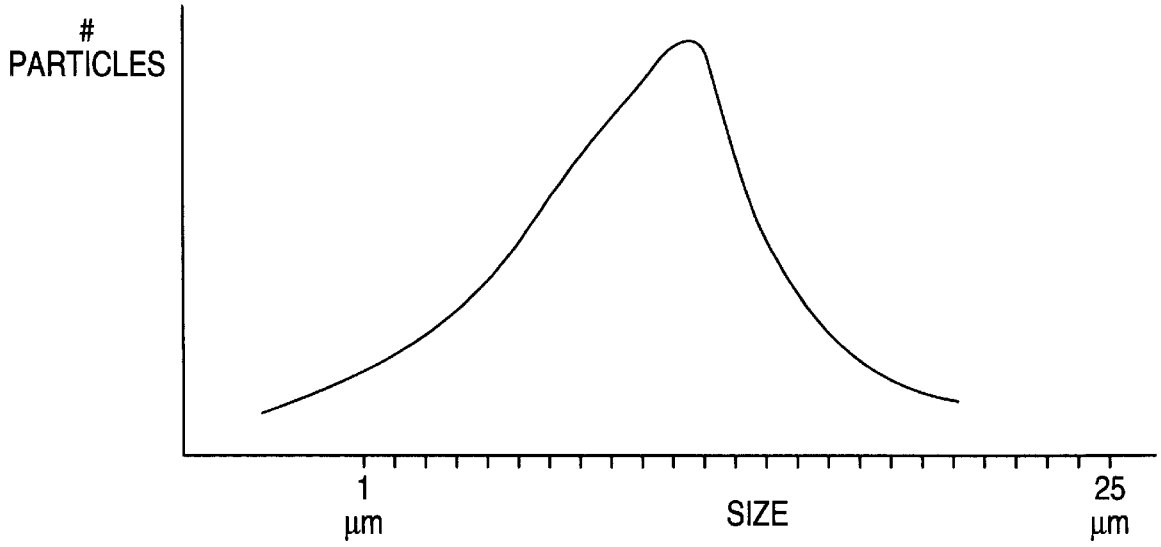
FIG. 5 is a graph illustrating an example of a unimodal particle size distribution typical of a single mixture of carbon black particles.

A formulation with the components recited below in Table 2 is coated on an 18 gage polyester film and dried at 180° F.

to obtain a thermal transfer ribbon with a thermal transfer layer having a mixture of particles with a wide unimodal particle size distribution consistent with FIG. 5.

TABLE 2

| Ingredient | Range | Dry Percent | Wet Weight |
|---|---|---|---|
| Wax emulsion [1] | 50 to 80 wt. % | 60% | |
| Carbon black dispersion [2] | 5 to 10 wt. % | 30% | |
| Polyethylene oxide | 2 to 15 wt. % | 10% | |
| Solvent | | | 300 |
| TOTALS | | 100% | |

[1] Emulsion 22854 - carnauba/paraffin/resin emulsion.
[2] Carbon black dispersion (29%) ground for 60 minutes.

Full transfer of the coating from the ribbon is observed on a step wedge at a temperature in the range of 260° F. to 300° F. The thermal transfer layer provides images at a print density of 2.15 and has a complex viscosity of $1\times10^6$ mPAs at 150° C.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A thermal transfer medium which comprises a flexible substrate and a thermal transfer layer deposited thereon as the outermost layer, said thermal transfer layer comprising a mixture of solid particles of a sensible material dispersed in a binder, wherein said mixture of solid particles of a sensible material comprises at least three different sizes of particles, wherein each of the different sized particles comprises 20 to less than 80 volume % of the total volume of solid particles of a sensible material and the different sized particles have values for average particle size which differ from each other by a factor of at least 1.5, and provide a multimodal particle size distribution.

2. A thermal transfer medium as in claim 1 wherein the solid particles of a sensible material are pigment particles.

3. A thermal transfer medium as in claim 2 wherein the mixture of pigment particles comprises a combination of at least three individual mixtures of carbon black particles, each having a distinct average particle size.

4. A thermal transfer medium as in claim 3 wherein the particle size distribution of each individual mixture is sufficiently narrow such that the standard deviation for the particle size is less than 25% of the average particle size for the individual mixture.

5. A thermal transfer medium as in claim 4 wherein the particle size distributions for the individual pigment mixtures do not overlap.

6. A thermal transfer medium as in claim 4 wherein the particle size distributions for the individual pigment mixtures do overlap.

7. A thermal transfer medium as in claim 3 wherein the particle size distribution of each individual mixture is sufficiently narrow such that each provides a mode in a multimodal particle size distribution.

8. A thermal transfer medium as in claim 7 wherein the particle size distributions for the individual pigment mixtures do not overlap.

9. A thermal transfer medium as in claim 7 wherein the particle size distribution for the individual pigment mixtures do overlap.

10. A thermal transfer medium as in claim 3 which provides images having a print density of 2.15 or more from a thermal transfer layer with a complex viscosity less than $8\times10^5$ mPAs at 150° C.

11. A thermal transfer medium as in claim 3, wherein the thermal transfer layer completely transfers to a substrate when exposed to the operating print head of a high speed thermal transfer printer.

12. A thermal transfer medium as in claim 1, wherein the thermal transfer layer completely transfers to a substrate when exposed to the operating print head of a high speed thermal transfer printer.

13. A thermal transfer medium which comprises a flexible substrate and a thermal transfer layer deposited thereon as the outermost layer, said thermal transfer layer comprising a mixture of solid pigment particles dispersed in a binder, wherein said mixture of solid pigment particles comprises at least six different sizes of particles, wherein each of the different sized pigment particles comprises at least 15 volume % of the total volume of solid pigment particles and have values for average particle size which differ from each other by a factor of at least 1.5.

* * * * *